US010924862B2

(12) United States Patent
Zhou et al.

(10) Patent No.: US 10,924,862 B2
(45) Date of Patent: Feb. 16, 2021

(54) MICRO SOUND DEVICE

(71) Applicant: AAC ACOUSTIC TECHNOLOGIES (SHENZHEN) CO., LTD., Shenzhen (CN)

(72) Inventors: Jiasheng Zhou, Shenzhen (CN); Dai Feng, Shenzhen (CN); Chenliang Kong, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/527,066

(22) Filed: Jul. 31, 2019

(65) Prior Publication Data

US 2020/0045434 A1 Feb. 6, 2020

(30) Foreign Application Priority Data

Aug. 3, 2018 (CN) ..... 201821255574.3

(51) Int. Cl.

| | |
|---|---|
| ***H04R 1/02*** | (2006.01) |
| ***H04R 9/00*** | (2006.01) |
| ***H04R 7/20*** | (2006.01) |
| ***H04R 9/02*** | (2006.01) |
| ***H04R 9/04*** | (2006.01) |
| ***H04R 7/12*** | (2006.01) |
| ***H04R 1/06*** | (2006.01) |
| ***H04R 9/06*** | (2006.01) |

(52) U.S. Cl.

CPC ..... *H04R 7/20* (2013.01); *H04R 1/06* (2013.01); *H04R 7/122* (2013.01); *H04R 7/127* (2013.01); *H04R 9/025* (2013.01); *H04R 9/045* (2013.01); *H04R 9/06* (2013.01); *H04R 2400/11* (2013.01); *H04R 2499/11* (2013.01)

(58) Field of Classification Search

CPC ..... H04R 1/02; H04R 1/025; H04R 1/026; H04R 9/00; H04R 9/025; H04R 9/027

USPC ..... 381/386, 398, 314

See application file for complete search history.

(56) References Cited

U.S. PATENT DOCUMENTS

2011/0135111 A1* 6/2011 Suzuki ..... H04R 9/022 381/86

2014/0153771 A1* 6/2014 Ohashi ..... H04R 9/06 381/412

* cited by examiner

*Primary Examiner* — Suhan Ni

(74) *Attorney, Agent, or Firm* — W&G Law Group LLP

(57) ABSTRACT

The present disclosure provides a micro sound device. The micro sound device includes a basket having an accommodating space, a vibration system secured to the basket, and a magnetic circuit system accommodated in the basket and configured to drive the vibration system to vibrate and produce sound. The vibration system includes an upper diaphragm secured to the basket, a voice coil located below the upper diaphragm and configured to drive the upper diaphragm to vibrate and produce sound, and a support apparatus elastically supporting the voice coil. The support apparatus is disposed opposite to the upper diaphragm and separately from the upper diaphragm. The magnetic circuit system includes an upper clamping plate secured to the basket. One end of the support apparatus is fixed to one side of the upper clamping plate and the other end of the support apparatus is fixed to the voice coil.

13 Claims, 4 Drawing Sheets

MICRO SOUND DEVICE

TECHNICAL FIELD

The present disclosure relates to acoustoelectric conversion technology, and in particular, to a micro sound device.

BACKGROUND

In order to accommodate a development trend of audio devices and communication devices toward miniaturization and functionality, micro sound devices used in such devices are required to be more miniaturized, so that the micro sound devices can be fitted to other peripheral components more compactly. Especially with a development trend of mobile phones toward thinness and lightness, requirements on quality of micro sound devices used thereof are becoming higher and higher.

In related technologies, a micro sound device includes a lower diaphragm, a flexible circuit board, a basket, and a magnetic bowl. The lower diaphragm and the flexible circuit board are glued to the basket, and the magnetic bowl is accommodated in the basket. However, such a structure occupies space in a vibration direction, and the micro sound devices cannot be produced thinner. In addition, a folded ring of the lower diaphragm faces to the magnetic bowl, and such a structure for a lower diaphragm also occupies space in the vibration direction.

Therefore, it is necessary to provide a new micro sound device to resolve the foregoing problems.

DETAILED DESCRIPTION

Figure 1:
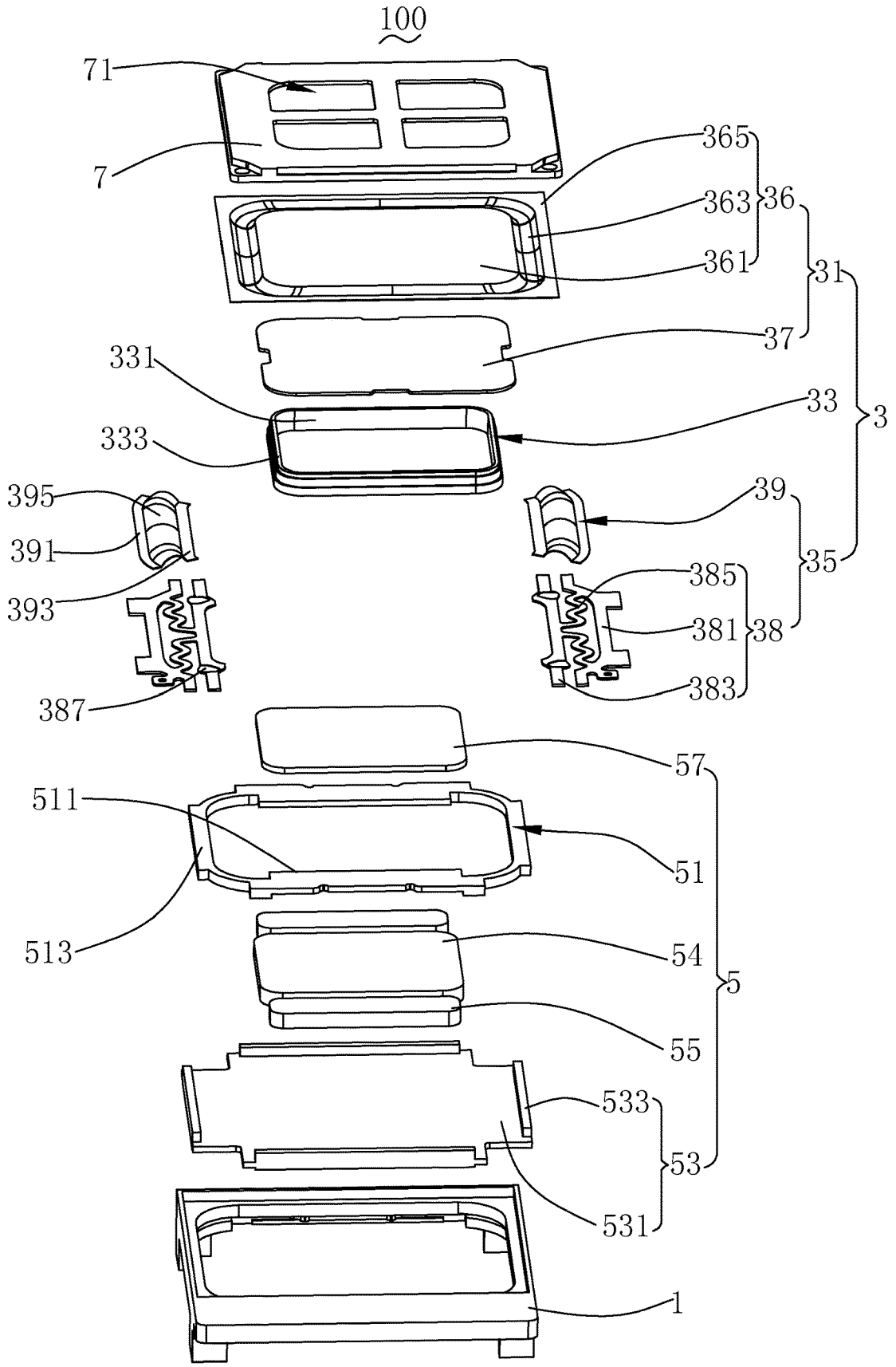
FIG. 1 is a schematic perspective exploded view of a micro sound device in the present disclosure.
Figure 2:
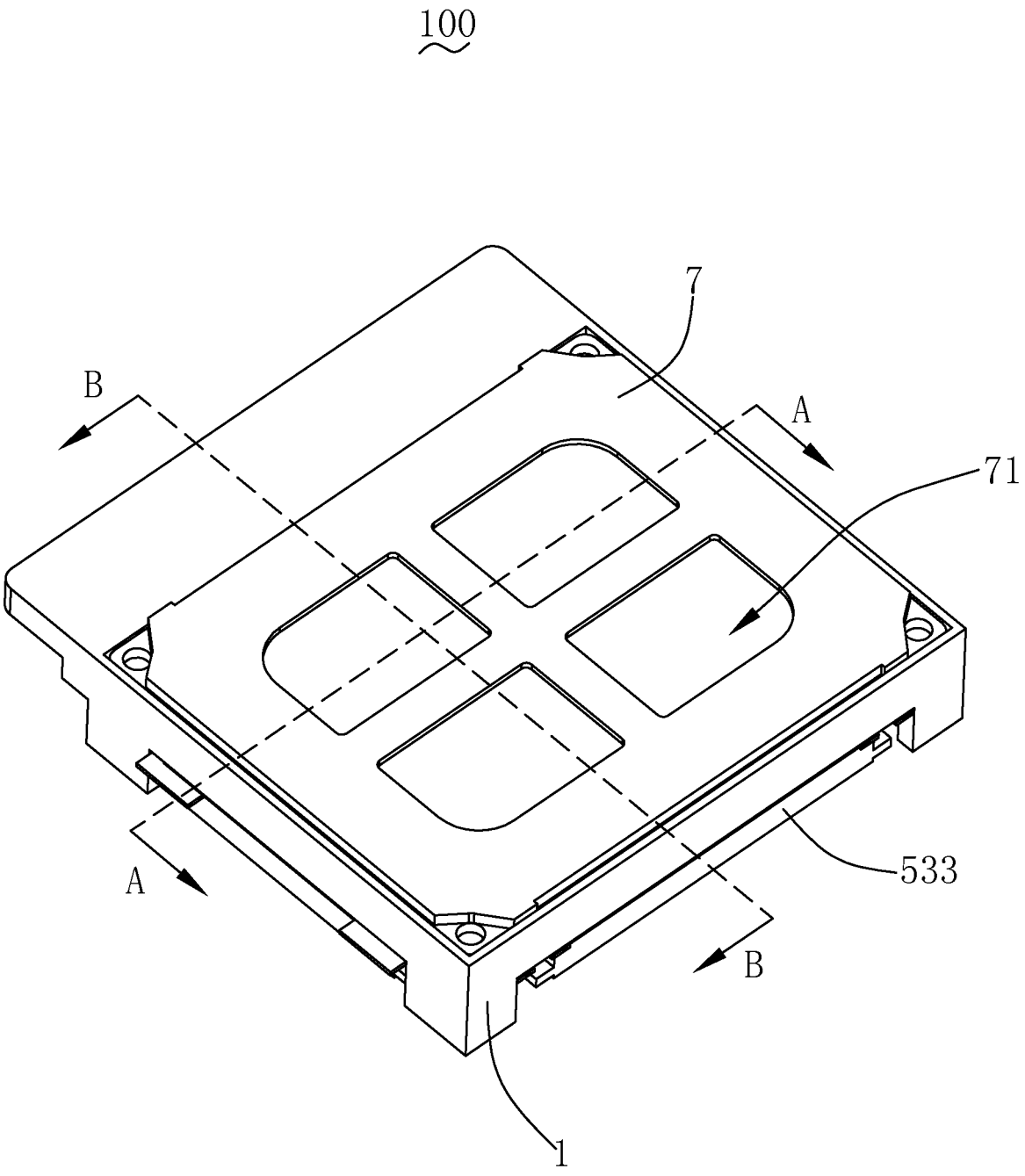
FIG. 2 is a perspective assembled view of the micro sound device shown in FIG. 1.

The following clearly and completely describes technical solutions in embodiments of the present disclosure with reference to accompanying drawings in the embodiments of the present disclosure. Apparently, the described embodiments are merely some rather than all embodiments of the present disclosure. All other embodiments obtained by those of ordinary skills in the art based on the embodiments of the present disclosure without creative efforts shall fall within the protection scope of the present disclosure.

As shown in FIGS. 1-4, a micro sound device 100 includes a basket 1 having an accommodating space, a vibration system 3 secured to the basket 1, and a magnetic circuit system 5 accommodated in the basket 1 and configured to drive the vibration system 3 to vibrate and produce sound.

The magnetic circuit system 5 includes an upper clamping plate 51 secured to the basket 1.

The vibration system 3 includes an upper diaphragm 31 fixed to the basket 1, a voice coil 33 located below the upper diaphragm 31 and configured to drive the upper diaphragm 31 to vibrate and produce sound, and a support apparatus 35 elastically supporting the voice coil 33. The support apparatus 35 is disposed opposite to the upper diaphragm 31 and separately from the upper diaphragm 31. One end of the support apparatus 35 is fixed to one side of the upper clamping plate 51 facing away from the upper diaphragm 31 and the other end of the support apparatus is fixed to the voice coil 33. The voice coil 33 is connected to an external circuit and vibrates under the action of a magnetic field of the magnetic circuit system 5 after being electrified. At the same time, the voice coil 33 drives the upper diaphragm 31 and the support apparatus 35 to vibrate together.

Figure 3:
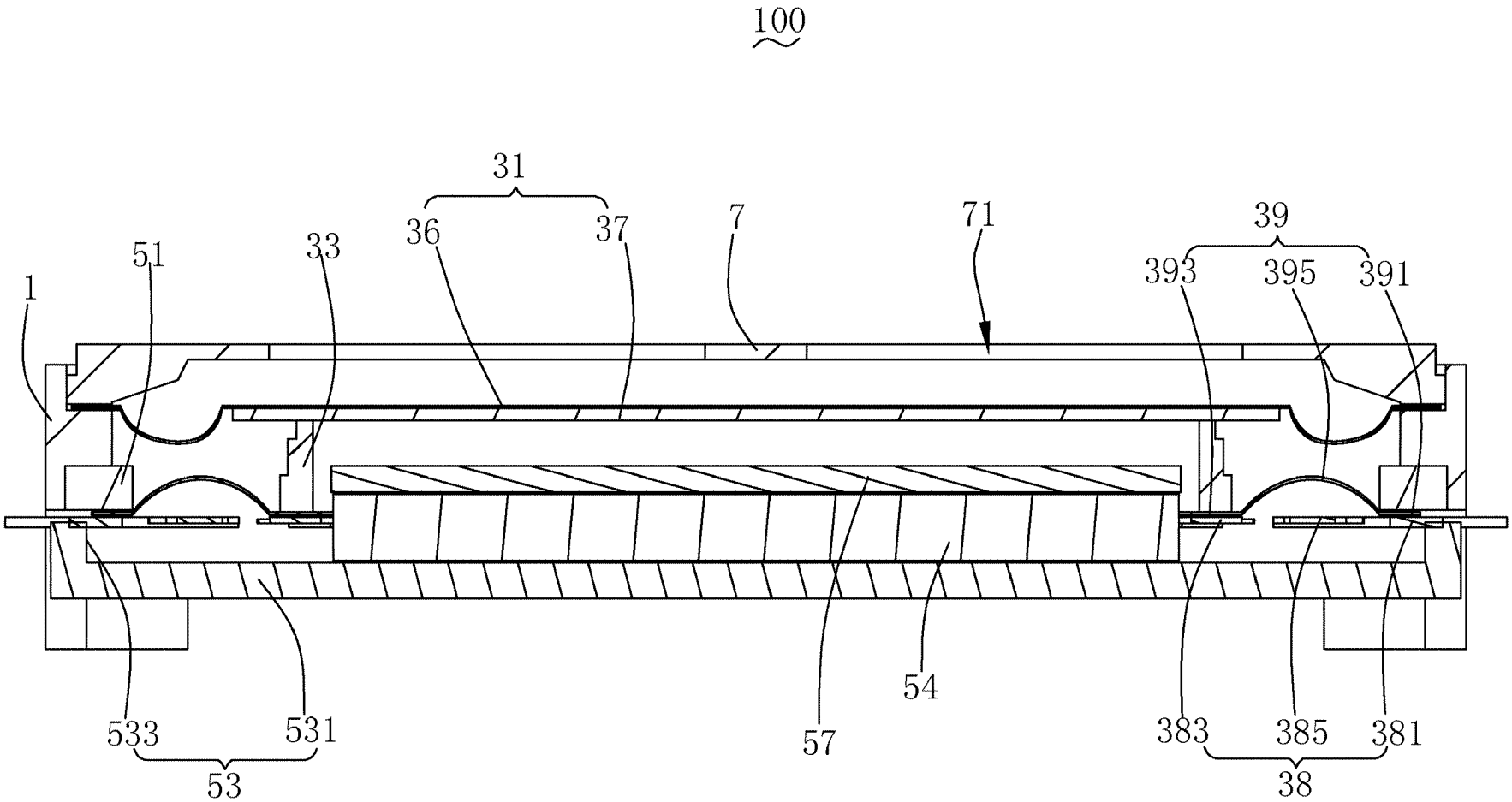
FIG. 3 is a cross-sectional view of the micro sound device along an A-A line shown in FIG. 2.
Figure 4:
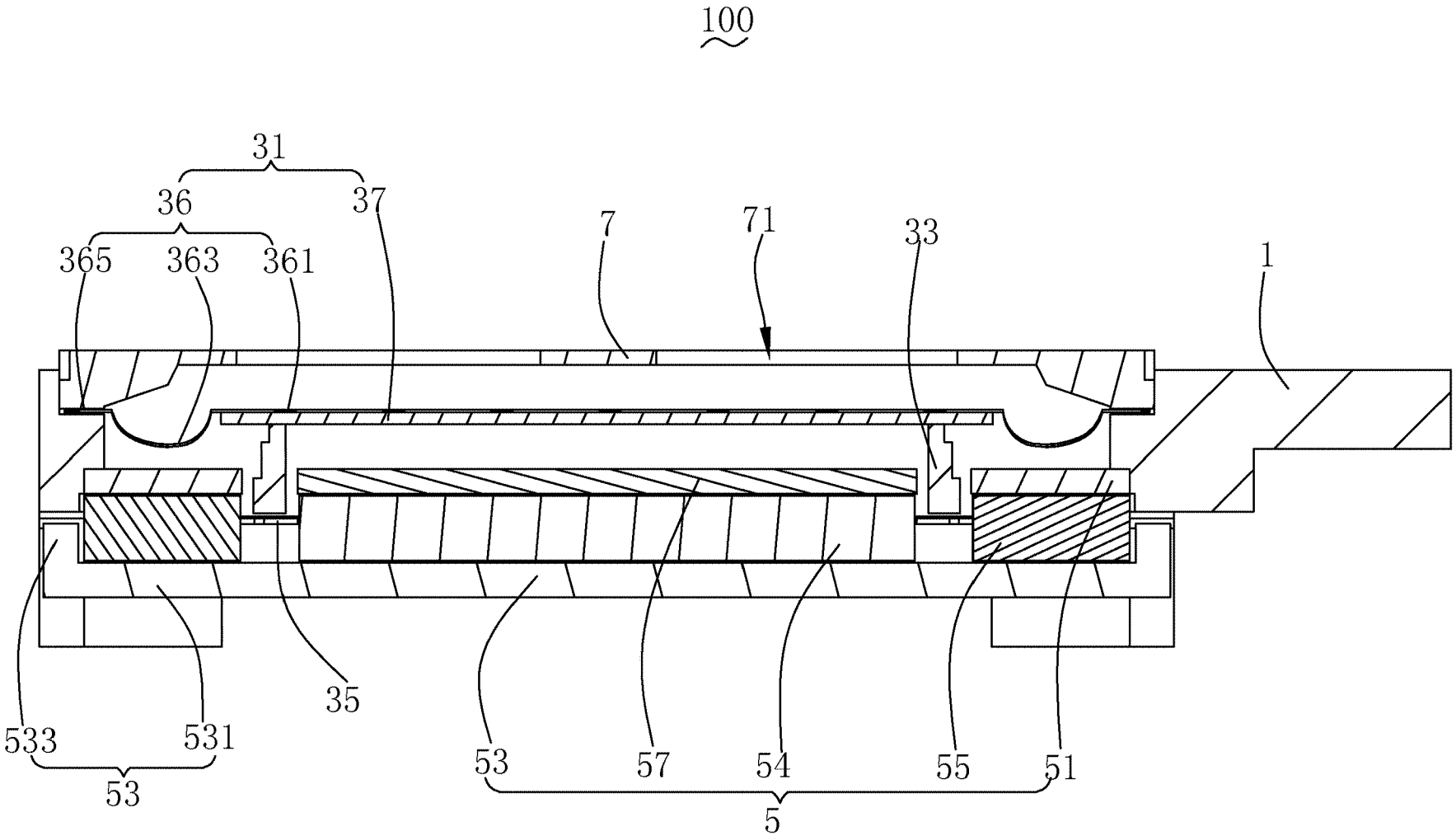
FIG. 4 is a cross-sectional view of the micro sound device along a B-B line shown in FIG. 2.

As shown in FIG. 1, FIG. 3, and FIG. 4, the upper diaphragm 31 includes a sound membrane 36 and a dome 37. The sound membrane 36 includes a flat portion 361, a folded ring portion 363 extending outward from the flat portion 361, and a joint portion 365 surrounding the folded ring portion 363. The dome 37 is sandwiched between the voice coil 33 and the flat portion 361. In this embodiment, the flat portion 361 is a complete flat plate structure. Of course, in other embodiments, the flat portion 361 may be sandwiched between the voice coil 33 and the dome 37. Or, the flat portion 361 may have a hole in the center, and the dome 37 covers the hole. Or, when the flat portion 361 is a complete flat plate structure, the lower diaphragm 31 may not include the dome, and the flat portion of the sound membrane is connected to the voice coil.

In this embodiment, the folded ring portion 363 is arc-shaped and has an opening facing away from the support apparatus 35. Because the opening of the folded ring portion 363 faces away from the support apparatus 35, a thickness of the micro sound device 100 in a vibration direction of the upper diaphragm 31 can be reduced.

The voice coil 33 as a whole is in a rectangular shape. The voice coil 33 includes a pair of long shaft sides 331 and a pair of short shaft sides 333, either of the pair of the short shaft sides 333 is disposed with the support apparatus 35, and one end of the support apparatus 35 away from the upper clamping plate 51 is fixed to the short shaft sides 333. The elastic support force of the support apparatus 35 can effectively prevent the voice coil 33 from swinging in a direction along the long shaft sides.

The support apparatus 35 includes a flexible circuit board 38 and a lower diaphragm 39 sandwiched between the flexible circuit board 38 and the voice coil 33. The voice coil 33 vibrates under the action of the magnetic field of the magnetic circuit system 5 after being electrified, and then the voice coil 33 drives the lower diaphragm 39 to vibrate together, thereby further improving sound effects of the micro sound device 100.

The lower diaphragm 39 includes a first fixing portion 391 fixedly connected to the upper clamping plate 51, a second fixing portion 393 fixedly connected to the short shaft sides 333 of the voice coil 33, and a folded ring 395 connecting the first fixing portion 391 and the second fixing portion 383. The folded ring 395 is an arc-shaped structure and has an opening facing away from the upper diaphragm 31. As the opening of the folded ring 395 faces away from the upper diaphragm 31, the thickness of the micro sound device 100 in the vibration direction of the upper diaphragm 31 can be reduced.

The flexible circuit board 38 includes a third fixing portion 381 connected to the first fixing portion 391 and a fourth fixing portion 383 connected to the second fixing portion 393. The third fixing portion 381 is disposed separately from the fourth fixing portion 383. The flexible circuit board 38 further includes an elastic connecting portion 385 connecting the third fixing portion 381 and the fourth fixing portion 383.

The fourth fixing portion 383 is formed with a solder pad 387 connected to a lead of the voice coil 33, and the solder pad 387 is located on one side of the fourth fixing portion 383 facing to the voice coil 33.

The micro sound device 100 further includes a cover plate 7 covering the upper diaphragm 31, and the cover plate 7 is provided with a sound outlet 71. The sound outlet 71 is used as an output channel for sound produced by vibration of the upper diaphragm 31.

The magnetic circuit system 5 further includes a magnetic bowl 53, a main magnetic steel 54, an auxiliary magnetic steel 55, and a pole core 57. The magnetic bowl 53 is fixed to one end of the basket 1 away from the upper diaphragm 31. The main magnetic steel 54 and the auxiliary magnetic steel 55 are fixed to the magnetic bowl 53. The upper clamping plate 51 is stacked on the auxiliary magnetic steel 55. The pole core 57 is stacked on the main magnetic steel 54. The upper clamping plate 51 has a through hole. The pole core 57 is located in the through hole of the upper clamping plate 51 and is in the same plane with the upper clamping plate 51. The main magnetic steel 54 is disposed separately from the auxiliary magnetic steel 55, and a magnetic gap is formed between the main magnetic steel 54 and the auxiliary magnetic steel 55. One end of the voice coil 33 away from the upper diaphragm 31 is inserted into the magnetic gap.

The upper clamping plate 51 includes a magnetic conductive portion 511 covering the auxiliary magnetic steel 55 and a fixing portion 513 extending from the magnetic conductive portion 511 in a bending manner. The support apparatus 35 is fixed to the fixing portion 513, and one end of the fixing portion 513 away from the support apparatus 35 is fixed to the basket 1. Specifically, the first fixing portion 391 of the lower diaphragm 39 of the support apparatus 35 is fixedly connected to the fixing portion 513.

The main magnetic steel 54 as a whole is in a rectangular shape.

There are two auxiliary magnetic steels 55, and the two auxiliary magnetic steels 55 are symmetrically disposed on two opposite sides of the main magnetic steel 54. The magnetic conductive portion 511 corresponds to the auxiliary magnetic steel 55 respectively. The magnetic conductive portion 511 and the fixing portion 513 form a continuous ring.

The magnetic bowl 53 includes a bottom plate 531 fixing the main magnetic steel 54 and the auxiliary magnetic steel 55 and a side plate 533 extending from an edge of the bottom plate 531 toward the upper diaphragm 31 in a bending manner, and the support apparatus 35 is sandwiched between the fixing portion 513 of the upper clamping plate 51 and the side plate 533. Specifically, the first fixing portion 391 of the lower diaphragm 39 of the support apparatus 35 and the third fixing portion 381 of the flexible circuit board 38 are sandwiched between the fixing portion 513 and the side plate 533.

With respect to the micro sound device 100 in the present disclosure, one end of the support apparatus 35 is fixed to one side of the upper clamping plate 51 away from the upper diaphragm 31, so that space can be saved in the vibration direction of the upper diaphragm.

The foregoing descriptions are merely embodiments of the present disclosure. It should be noted herein that those of ordinary skill in the art may make improvements without departing from the inventive concept of the present disclosure, and such improvements shall all fall within the protection scope of the present disclosure.

What is claimed is:

1. A micro sound device, comprising a basket having an accommodating space, a vibration system secured to the basket, and a magnetic circuit system accommodated in the basket and configured to drive the vibration system to vibrate and produce sound, wherein the vibration system comprises an upper diaphragm secured to the basket, a voice coil located below the upper diaphragm and configured to drive the upper diaphragm to vibrate and produce sound, and a support apparatus elastically supporting the voice coil, wherein the support apparatus is disposed opposite to the upper diaphragm and separately from the upper diaphragm, and the magnetic circuit system comprises an upper clamping plate secured to the basket, wherein one end of the support apparatus is fixed to one side of the upper clamping plate away from the upper diaphragm, and the other end of the support apparatus is fixed to the voice coil;

wherein the support apparatus comprises a flexible circuit board and a lower diaphragm sandwiched between the flexible circuit board and the voice coil, the lower diaphragm comprises a first fixing portion fixedly connected to the upper clamping plate, a second fixing portion fixedly connected to the voice coil, and a folded ring connecting the first fixing portion and the second fixing portion, and the flexible circuit board comprises a third fixing portion connected to the first fixing portion and a fourth fixing portion connected to the second fixing portion, wherein the folded ring is an arc-shaped structure having an opening facing away from the upper diaphragm.

2. The micro sound device according to claim 1, wherein the third fixing portion is disposed separately from the fourth fixing portion, and the flexible circuit board further comprises an elastic connecting portion connecting the third fixing portion and the fourth fixing portion.

3. The micro sound device according to claim 2, wherein the fourth fixing portion is formed with a solder pad connected to a lead of the voice coil, and the solder pad is located on one side of the fourth fixing portion facing the voice coil.

4. The micro sound device according to claim 1, wherein the voice coil comprises a pair of long shaft sides and a pair of short shaft sides, either of the pair of the short axis edges is disposed with the support apparatus, and the second fixing portion is fixed to the short shaft sides.

5. The micro sound device according to claim 4, wherein the fourth fixing portion is formed with a solder pad connected to a lead of the voice coil, and the solder pad is located on one side of the fourth fixing portion facing the voice coil.

6. The micro sound device according to claim 1, wherein the fourth fixing portion is formed with a solder pad connected to a lead of the voice coil, and the solder pad is located on one side of the fourth fixing portion facing the voice coil.

7. The micro sound device according to claim 1, wherein the upper diaphragm comprises a sound membrane, the sound membrane comprises a flat portion, a folded ring portion extending outward from the flat portion, and a joint portion surrounding the folded ring portion, wherein the folded ring portion is arc-shaped and has an opening facing away from the support apparatus.

8. The micro sound device according to claim 7, wherein the upper diaphragm further comprises a dome, and the dome is sandwiched between the voice coil and the flat portion.

9. The micro sound device according to claim 1, wherein the micro sound device further comprises a cover plate covering the upper diaphragm, and the cover plate is provided with a sound outlet.

10. The micro sound device according to claim 1, wherein the magnetic circuit system further comprises a magnetic bowl fixed to one end of the basket away from the upper diaphragm, a main magnetic steel fixed to the magnetic bowl, and an auxiliary magnetic steel fixed to the magnetic bowl and separated from the main magnetic steel, and the upper clamping plate comprises a magnetic conductive portion covering the auxiliary magnetic steels and a fixing portion extending from the magnetic conductive portion in a bending manner, wherein the support apparatus is fixed to the fixing portion, and one side of the fixing portion facing away from the support apparatus is fixed to the basket.

11. The micro sound device according to claim 10, wherein the auxiliary magnetic steel are symmetrically disposed on two opposite sides of the main magnetic steel, the magnetic conductive portion corresponds to the auxiliary magnetic steel respectively, and the magnetic conductive portion and the fixing portion form a continuous ring.

12. The micro sound device according to claim 11, wherein the magnetic bowl comprises a bottom plate fixing the main magnetic steel and the auxiliary magnetic steel and a side plate extending from an edge of the bottom plate toward the upper diaphragm in a bending manner, and the support apparatus is sandwiched between the fixing portion and the side plate.

13. The micro sound device according to claim 10, wherein the magnetic bowl comprises a bottom plate fixing the main magnetic steel and the auxiliary magnetic steel and a side plate extending from an edge of the bottom plate toward the upper diaphragm in a bending manner, and the support apparatus is sandwiched between the fixing portion and the side plate.

* * * * *